United States Patent [19]

Yamagishi et al.

[11] Patent Number: 4,714,941

[45] Date of Patent: Dec. 22, 1987

[54] COPYING APPARATUS HAVING A CONTROLLED SCANNING SPEED ACCORDING TO A COPYING MAGNIFICATION

[75] Inventors: Toshio Yamagishi, Nara; Katsuyoshi Fujiwara, Osaka, both of Japan

[73] Assignee: Sharp Kabushiki Kaisha, Osaka, Japan

[21] Appl. No.: 852,210

[22] Filed: Apr. 15, 1986

[30] Foreign Application Priority Data

Apr. 16, 1985 [JP] Japan ..... 60-83263
Apr. 16, 1985 [JP] Japan ..... 60-83264

[51] Int. Cl.[4] ..... G03G 15/00

[52] U.S. Cl. ..... 355/8; 355/14 R; 355/14 SH; 355/55

[58] Field of Search ..... 355/7, 8, 14 R, 14 SH, 355/14 C, 55

[56] References Cited

U.S. PATENT DOCUMENTS 4,129,377 12/1978 Miyamoto et al. ..... 355/14 SH
4,417,806 11/1983 Tani et al. ..... 355/14 SH
4,451,136 5/1984 Tanioka et al. ..... 355/14 SH
4,461,564 7/1984 Ikenoue ..... 355/14 SH X

*Primary Examiner*—Arthur T. Grimley
*Assistant Examiner*—J. Pendergrass
*Attorney, Agent, or Firm*—Birch, Stewart, Kolasch & Birch

[57] ABSTRACT

An improved copying apparatus for copying by shifting images by a desired distance, and also for copying the central portion of a copy paper sheet according to copying factors such as the copy paper sheet sizes, original document sizes and copying magnifications.

3 Claims, 13 Drawing Figures

COPYING APPARATUS HAVING A CONTROLLED SCANNING SPEED ACCORDING TO A COPYING MAGNIFICATION

BACKGROUND OF THE INVENTION

The present invention generally relates to a copying arrangement and more particularly, to a copying apparatus for effecting copying operations by subjecting an original document scanning means including a reciprocating means such as an optical unit, original document platform or the like, to a constant speed scanning.

More specifically, the present invention relates to a copying apparatus provided with an original document scanning means including a reciprocating means such as an optical unit or original document platform, etc., with the scanning speed thereof being adapted to be controlled according to the copying magnifications, and characterized in that an acceleration time required for the original document scanning means to scan from its home position, for example, to an original document leading edge position is obtained by information acquired in advance through a preliminary scanning, and timing for feeding copy paper sheets is arranged to be determined based on a reference time obtained by adding to said acceleration time, time required for an exposure position on a photoreceptor drum to reach a transfer position, and time required for feeding the copy paper sheet between a copy paper sheet leading edge position and an image leading edge position in the case where copying is effected at a central portion of a copy paper sheet.

Conventionally, for copying images of an original document onto a copy paper sheet, there has been employed a practice to effect the copying at a position where the original document is slightly deviated with respect to the copy paper sheet depending on necessity. However, the known practice as referred to above is such that, with respect to a reference time point when an original document scanning means has reached the position of the original document leading edge, timing for feeding the copy paper sheet is determined within the range in which the original document scanning means is moved at a constant speed, and thus, the shiftable distance thereby is limited only to approximately several tens of millimeters.

Referring to FIG. 3, there is shown a schematic diagram for explaining a general construction and functions of an optical system movable type copying apparatus, which generally includes a housng H, an original document platform 7 of a transparent material such as a glass plate or the like, provided at the upper portion of the housing H, an optical unit including a first mirror 1, a second mirror 2 and a third mirror 3 and also a zoom lens 5 and a fourth mirror 4 and disposed below and adjacent to the platform 7, a photoreceptor drum 6 having a photosensitive surface 6a on its outer peripheral portion and rotatably provided generally at the central portion of the housing H, and a copy paper sheet feeding passage G having a paper start clutch PSC at a position P6 and provided at the lower portion of said housing H for feeding the copy paper sheets accommodated in a paper sheet cassette F towards the transfer position at P5 immediately below the photoreceptor drum 6.

In the copying apparatus of FIG. 3, scanning of an original document (not shown) placed on the platform 7 is effected as the optical unit including the first, second and third mirrors 1, 2 and 3 scans said platform 7. The copy paper sheet fed along the feeding passage G is once stopped at the position P6 for the paper start clutch PSC so as to be further transported at a predetermined timing. In the arrangement as described so far, it has been a conventional practice that a timer (not shown) is actuated from a time point when the first mirror 1 has reached a point P2 so as to control the paper start clutch PSC after a lapse of a predetermined period of time, and in this case, a maximum shiftable distance may be represented by L1-L2 when a distance between the exposure position P4 and the transfer position P5 of the photoreceptor drum 6 is denoted by L1 and a distance between the position P6 for the clutch PSC and the transfer position P5 is represented by L2. Therefore, the shiftable distance is limited only to 10 to 20 mm at the most as described earlier. Meanwhile, when the original document scanning means is arranged to travel at a constant speed before the leading edge of the original document is subjected to exposure, the distance to be covered from the starting of the original document scanning means to the exposing of the original document leading edge must be set to be large, thus resulting in a large size of the copying apparatus on the whole.

However, it has been a recent trend that copying magnifications applicable to actual copying tend to expand in directions both for enlargement and contraction, while image editing is also extensively effected, with large shifts e.g. in the order of 100 and 200 mm which can not be achieved by the conventional image shifting methods coming to be required. Therefore, for example, transfer of a contracted image onto the central portion of a copy paper sheet (referred to as "centering" hereinafter) could not be effected automatically.

SUMMARY OF THE INVENTION

Accordingly, it is an essential object of the present invention to provide a copying apparatus which is capable of effecting copying through shifting of any desired distance, with substantial elimination of disadvantages inherent in the conventional copying apparatuses of this kind.

Another important object of the present invention is to provide a copying apparatus of the above described type which is capable of copying at the central portion of a copy paper sheet according to copying factors such as the copy paper sheet size, original document size, and copying magnification.

The basic principle of the present invention resides in that, in the case where an original document scanning means such as the optical unit referred to earlier is to be caused to scan, feeding of the copy paper sheet is made possible before the original document scanning means reaches the predetermined constant speed by finding the time required for the original document scanning means to move from a home position to a reference position such as the original document leading edge position.

Since the scanning speed of the original document scanning means varies according to the magnification to be employed for the copying, so does the time required for the original document scanning means to move from the home position to the reference position such as the original document leading edge position, depending on the copying magnification, the examples of which are shown in a diagram of FIG. 1.

In FIG. 1, the scanning speed of the original document scanning means when the copying magnification is at the maximum is denoted by Vm1, while that of the original document scanning means at the minimum copying magnification is represented by Vm 2. As is seen from the diagram of FIG. 1, based on the driving characteristics for the original document scanning means, the scanning means reaches the constant speed sooner as the scanning speed is increased. A home position switch represented by HPS is brought into an off state when the original document scanning means has passed the home position. Denoted by EP are pulses detected by a rotary slit disc (rotary encoder) attached to a driving system for driving the original document scanning means, and the number of these pulses is counted after turning off the home position switch HPS subsequent to starting of the original document scanning means to establish the reference position at the timepoint when the number has reached n pieces. More specifically, Tm 1 denotes an acceleration time required for the original document scanning means to move from the home position to the reference position after starting the functioning at the maximum copying magnification, while Tm 2 represents the acceleration time required for the scanning means to move from the home position to the reference position after starting the function at the minimum copying magnification.

As described above, by obtaining the time required for the original document scanning means to reach the reference position as values corresponding to at least two different copying magnifications, acceleration time at any desired copying magnification may be obtained.

FIG. 2 shows a diagram representing a method for the above purpose, and as is seen from this diagram, the copying magnification and acceleration time are represented by a primary function, and the acceleration time Tm at any arbitrary copying magnification m may be obtained by the following formula.

$$Tm = Tm1 + (Tm1 - Tm2) \times (m - m1)/(m1 - m2)$$

When a time obtained by adding to the acceleration time calculated by the above equation, the time for the exposure position (P4 in FIG. 3) on the photoreceptor drum to reach the transfer position (P5), is regarded as a reference time, feeding timing of the copy paper sheet may be set. More specifically, when a time difference between the timing at which the original document scanning means starts functioning and the timing at which the copy paper sheet is transported, is represented by ΔT, it will be obtained by the following equation.

$$\Delta T = Tm + (L1 - L2)/V0 \quad (1)$$

where L1 and L2 represent the distances shown in FIG. 3 as referred to earlier, and V0 denotes the circumferential speed of the photoreceptor drum, i.e. copy paper sheet feeding speed.

Since the transfer position with respect to the copy paper sheet is determined by the time relation as described above, it becomes possible to effect the desired shifting of the copying image, if the feed timing of the copy paper sheet is controlled by adding to or subtracting from the above time, the time required for shifting the image.

By way of example, if the distance to be shifted is represented by SH, the time required for the copy paper sheet to be transported through that distance may be given by SH/V0. Accordingly, the feed timing for the copy paper sheet may be obtained by the following equation.

$$\Delta TS = \Delta T - SH/V0 \quad (2)$$

Therefore, in the case where copying is effected at the central portion of a copy paper sheet (referred to as centering), the time from the leading edge of the copy paper sheet to the leading edge of the image to be copied can be obtained as follows.

$$(S - m \times D)/2V0$$

Where D is the size of the original document (i.e. width thereof in the direction of scanning), S is the size of the copy paper sheet, and m is the copying magnification. Therefore, the timing for feeding the copy paper sheet may be calculated by an equation given below.

$$\Delta TC = \Delta T - (S - m \times D)/2V0 \quad (3)$$

In accomplishing the objects referred to above and other objects, according to one preferred embodiment of the present invention, there is provided a copying apparatus including means for causing an original document scanning means having a reciprocating means such as an optical unit, original document platform or the like, to scan at a constant speed, with the scanning speed thereof being adapted to be controlled according to copying magnifications, and characterized in the there are further provided means for preliminarily scanning by the original document scanning means before a copying exposure scanning at speeds corresponding to at least two different copying magnifications, means for measuring acceleration time of the original document scanning means from a home position to a reference position in a constant speed moving section corresponding to the at least two copying magnifications by the preliminary scanning, means for calculating acceleration time corresponding to any required copying magnification based on information of the acceleration time corresponding to the at least two copying magnifications, and means for setting timing for feeding a leading edge of a copy paper sheet to a transfer position, based on a reference time obtained by adding time required for an exposure position on a photoreceptor drum to reach the transfer position, to the calculated acceleration time.

By the arrangement of the present invention as described above, an improved copying apparatus has been presented through simple construction and at low cost.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
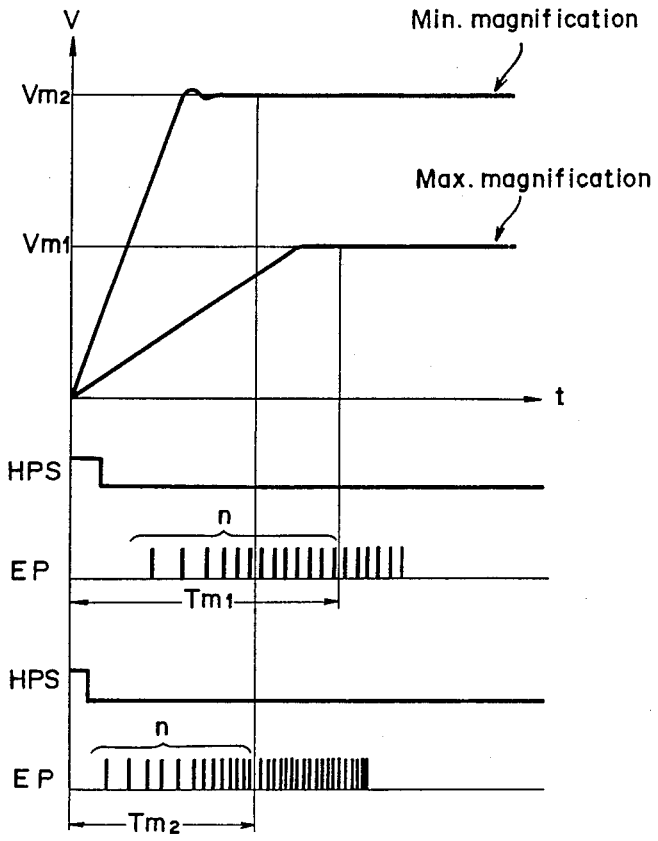
FIG. 1 is a diagram for explaining acceleration time of an original document scanning means in different magnification.

Before the description of the present invention proceeds, it is to be noted that like parts are designated by like reference numerals throughout the accompanying drawings.

Figure 8:
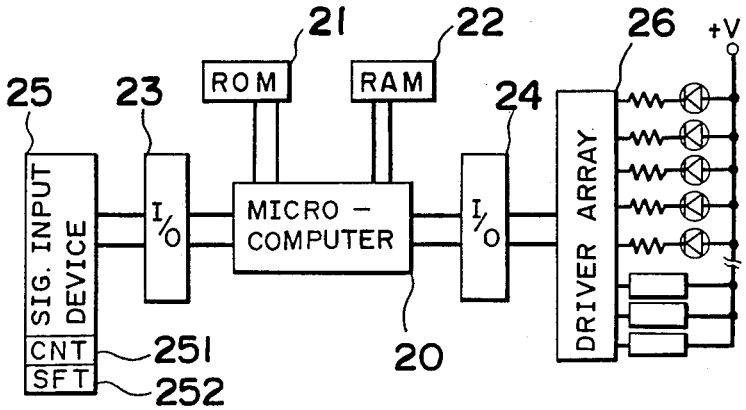
FIG. 8 is a block diagram showing construction of a control section for the copying apparatus according to the present invention.

Referring now to the drawings, there is shown in FIG. 8 a block diagram of a control section for a copying apparatus according to the present invention.

The control section in FIG. 8 generally comprises a micro-computer 20 including a ROM (read only memory) 21 for effecting the predetermined control according to the control program stored therein and a RAM (random access memory) 22 which is used as a region for buffer memory, flag and other calculations, a signal input device 25 for inputting signals of the key switch, copy paper sheet detecting switch, etc. which has a key 251 for instructing copying to transfer the image at the central portion of a copy paper sheet (referred to as "centering" hereinafter) and another key 252 for instructing shifting of the position for image transfer with respect to the copy paper sheet, and which is coupled to the micro-computer 20 through an interface circuit 23, and a display control circuit 26 (referred to as a driver array) for controlling the display of copying magnifications, and other displays, which is coupled to the micro-computer 20 through another interface circuit 24.

Figure 2:
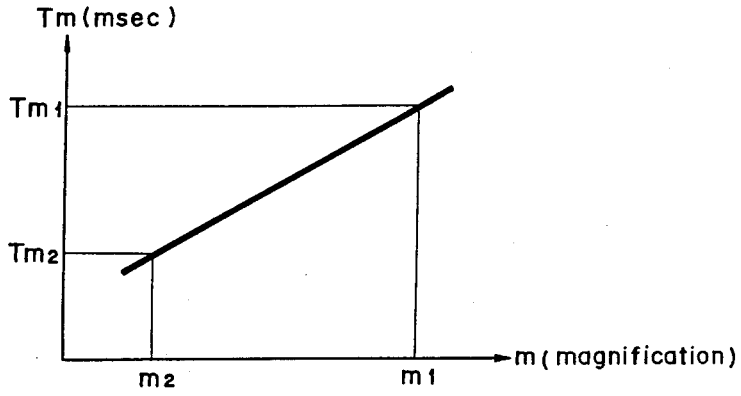
FIG. 2 is a graph showing the relation between the copying magnification and acceleration time.
Figure 9B:
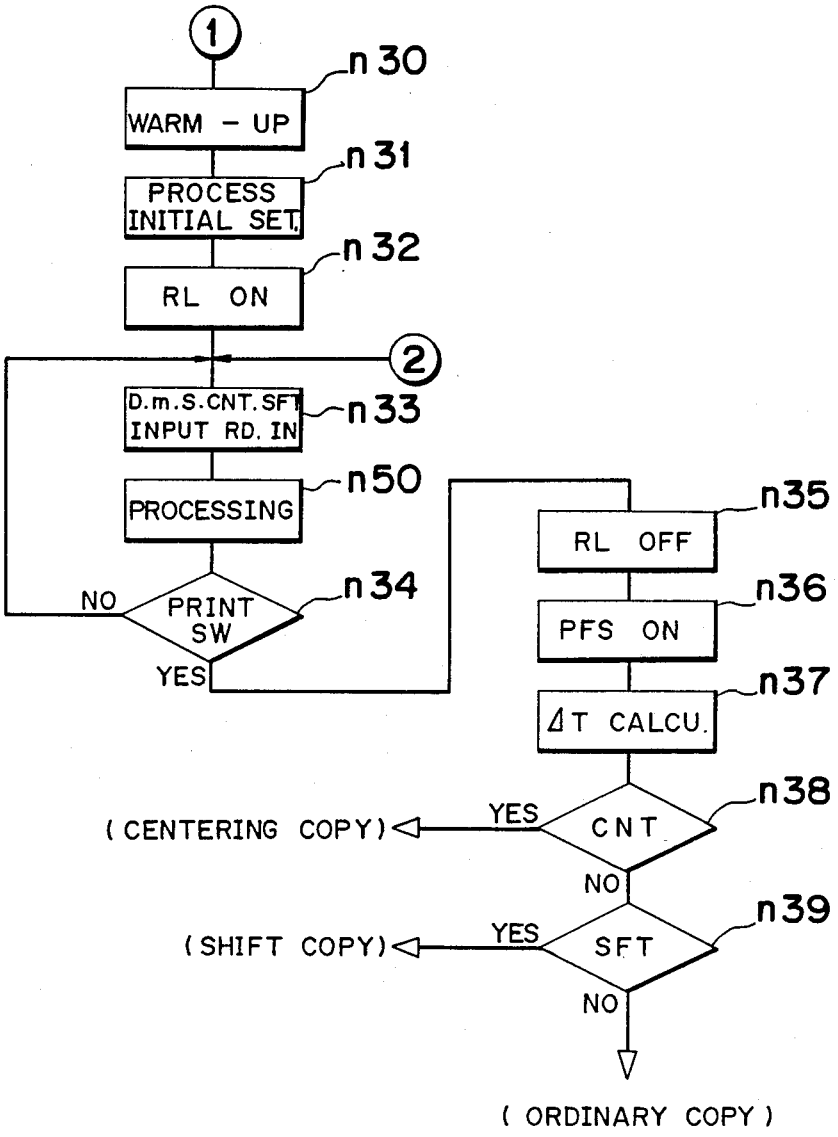
Figure 9A:
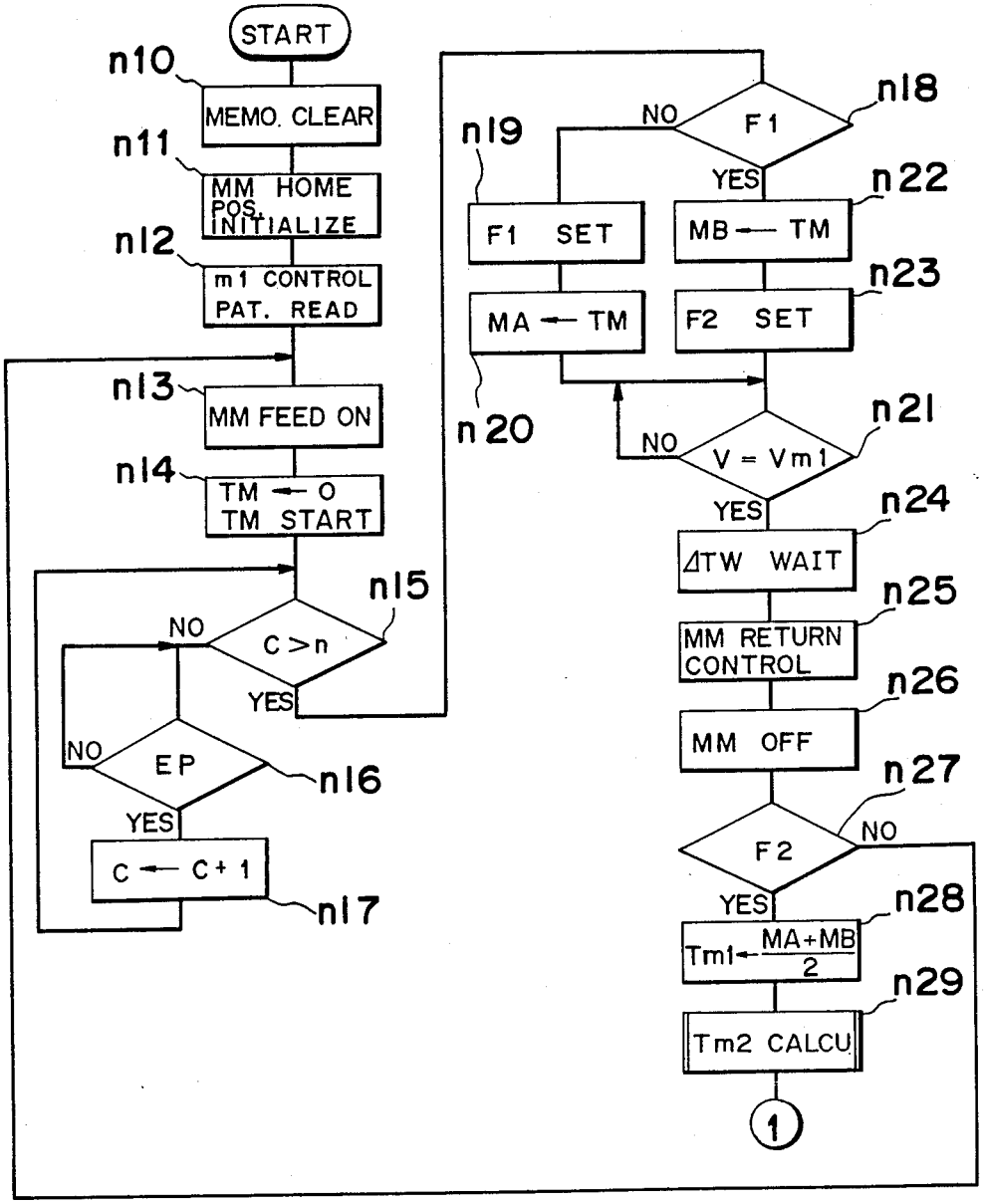

In FIG. 9(A), there is shown a flow-chart for obtaining time up to arrival at the reference position after starting of scanning by the original document scanning means, with respect to two different copying magnifications as shown in FIGS. 1 and 2.

First, upon turning on the power source of the copying apparatus, the memory is cleared at step n10, and the optical unit is returned to the home position at step n11, with a counter showing that position being initialized (MM means a mirror motor). At step n12, a control pattern for the copying magnification m1 is read out from the memory. This control pattern is the control data preliminarily determined according to the copying magnification, and the scanning by the original document scanning means is effected based on this data. More specifically, at step n13, the motor for driving the optical unit is turned on, while at step n14, a timer TM is reset for starting. Step n15 is intended to check whether or not the value of the counter C has reached a predetermined number n. Step n16 is to judge whether the encode pulses EP shown in FIG. 1 are produced, and upon generation of the encode pulses EP, the counter is incremented at step n17. In other words, by these steps from n15 to n17, counting is effected until the number of encode pulses reaches n pieces. Step n18 has for its object to check whether or not a flag F1 is in a reset state. At first, the flag F1 is in the reset state. Therefore, the flag F1 is first set at step n19, and at step n20, the value of the timer TM i.e. time for going out of the loop of steps n15 to n17, is stored in the memory MA. The above value of the timer is equivalent to the value for Tm1 as shown in FIG. 1.

Step n21 is the processing to ensure that the optical unit has reached a constant speed. However, since the optical unit is normally at the constant speed, the procedure is immediately reverted to step n24.

Step n24 is intended to wait for the time until the optical unit has been stabilized, and thereafter, the optical unit is returned to the home position at steps n25 and n26.

Although step n27 is for the judgement of a flag F2, since it is in the reset state at this time point, the procedure is reverted to step n13. Accordingly, similar functions as stated above are effected, but since the flag F1 is already in the set state at this time point, this is judged at step n18, and the value of the timer is stored in a memory MB at step n22. By setting the flag F2 at step n23, this is judged at step n27, and at step n28, an average of the values stored in the memories MA and MB is obtained to input the resultant value into Tm1. By the above procedures, the average acceleration time of the original document scanning means at the copying magnification of m1 is obtained. At step n29, similar processing as above is effected with the copying magnification set at m2. The average acceleration time at the copying magnification m2 is obtained as Tm2.

Figure 4:
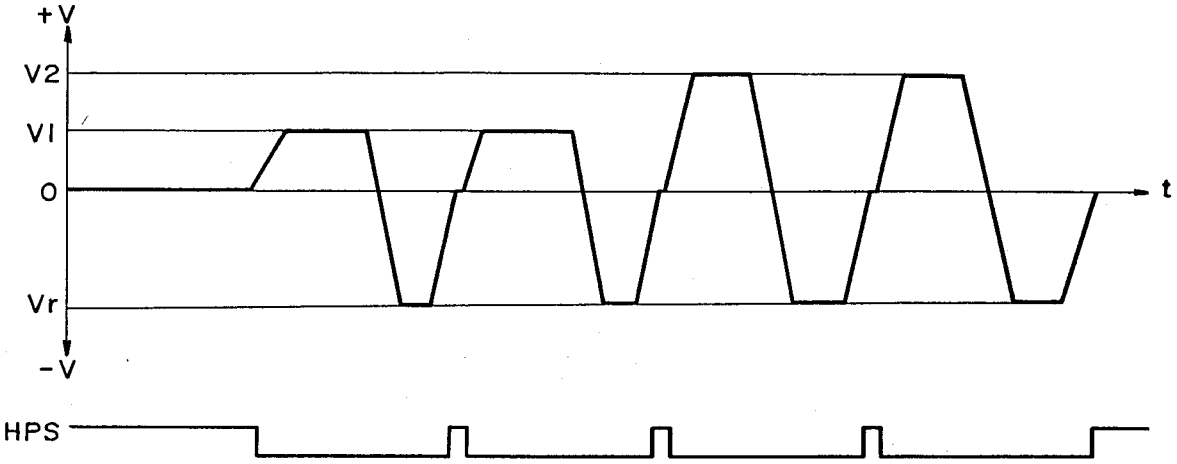
FIG. 4 is a diagram showing scanning speeds of the original document scanning means and signal of a home position switch.

Referring to FIG. 4, there is shown a speed pattern for the preliminary scanning of the original document scanning means (optical unit). In FIG. 4, V1 represents the scanning speed at the copying magnification m1, V2 denotes the scanning speed at the copying magnification m2, and Vr shows the speed during returning of the optical unit. As referred to earlier, HPS represents the signal of the home position switch. The return speed is constant irrespective of the copying magnification, because the returning of the optical unit does not contribute to the image forming process.

FIG. 9(B) relates to the processing subsequent to the preliminary scanning described earlier, and in the first place at step n30, warming-up of fixing rollers is effected, while at step n31, initial settings for various parts of copying mechanisms within the copying apparatus are carried out. Thereafter, at step n32, a ready lamp indicative of the state capable of copying is illuminated. At step n33, inputs such as the original document size D, copying magnification m, copy paper sheet size S, centering designation CNT, and shift designation SFT are read in. These data may be introduced through inputs from a keyboard or by automatic detection. At step n50, processings such as judgement whether or not the copying is possible, or obtaining the time required for the scanning of the original document scanning means are effected (such processings are to be described more in detail later with reference to FIG. 13). Step n34 relates to the judgement as to whether or not the print switch is operated, and if the print switch is actuated, the ready lamp is turned off at step n35, and a paper feeding roller (paper feed solenoid) is driven at step n36. At step n37, the calculation for ΔT is effected based on the equation (1) described earlier. Steps n38 and n39 relate to the judgement as to wether the processing for the copying is for the "centering" processing, shift copying or ordinary copying.

Figure 10:
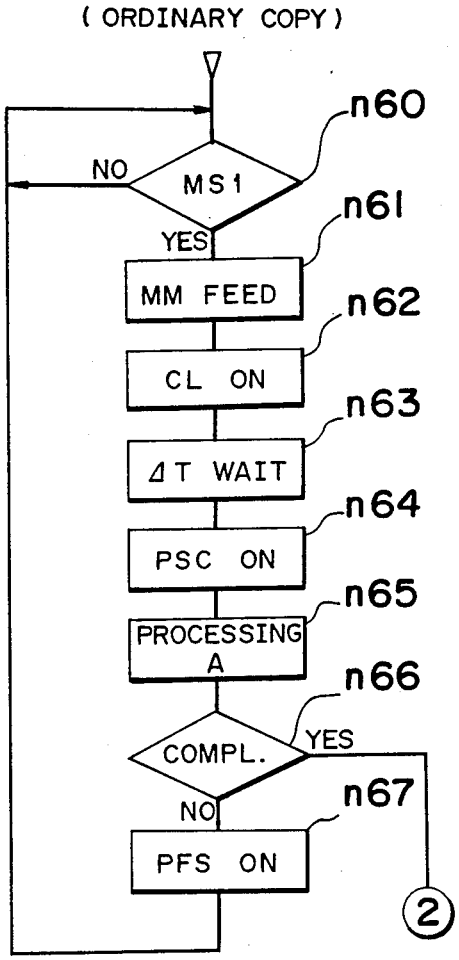
FIG. 10 is a flow-chart showing the processing procedure for an ordinary copying.

Reference is made to a flow-chart of FIG. 10 showing processing procedures in the ordinary copying.

Figure 3:
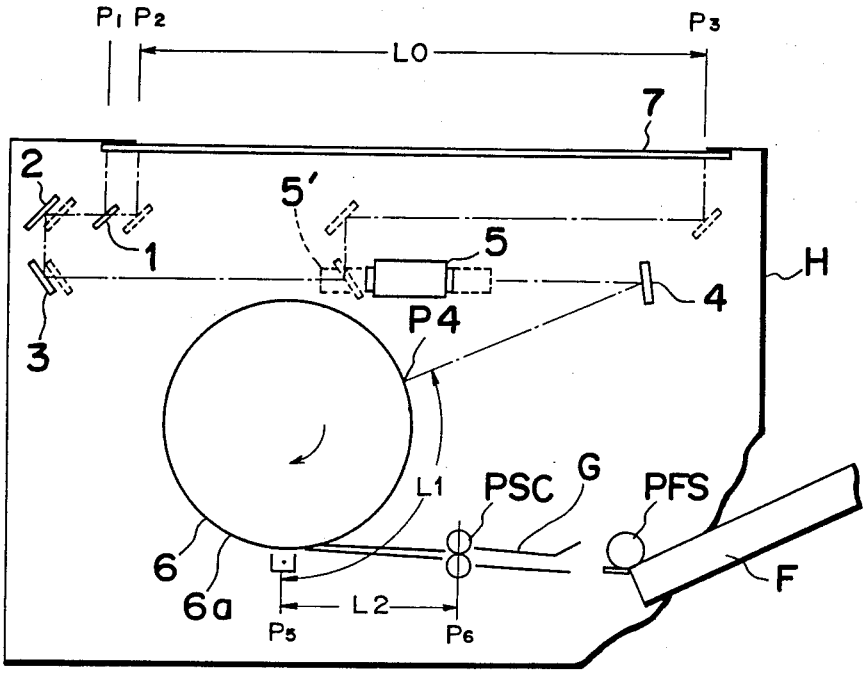
FIG. 3 is a schematic diagram showing a general construction of an optical system movable type copying apparatus to which the present invention may be applied.

Firstly, at step n60, the state of a paper detecting switch MS1 is checked. This detecting switch MS1 is intended to detect whether or not a copy paper sheet contacts the position of the paper start clutch PSC shown in FIG. 3, and if the copy paper sheet is in contact with the clutch PSC, scanning of the optical unit is started at step n61, and a copy lamp is turned on at step n62. Thereafter, at step n63, time waiting is effected for the time ΔT already obtained. After a lapse of the time ΔT, the paper start clutch PSC is turned on at step n64. In other words, the copy paper sheet is transported at this timing. Step n65 relates to processings for effecting transfer of the image onto the copy paper sheet thus fed, and finally, for discharging the copy paper sheet into a paper discharge tray. At step n66, judgement is made as to whether or not copying is completed for all the number of copy paper sheets to be copied, and if it is not completed, the paper feeding roller PFS (FIG. 3) is driven at step n67, and the procedure is returned to step n60 to repeat the similar processings. Upon completion of all the copying processings, the procedure returns to step n33 in FIG. 9(B). In the manner as described above, by feeding the copy paper sheet after the time ΔT subsequent to starting of operation of the optical unit, ordinary copying may be effected.

Figure 11:
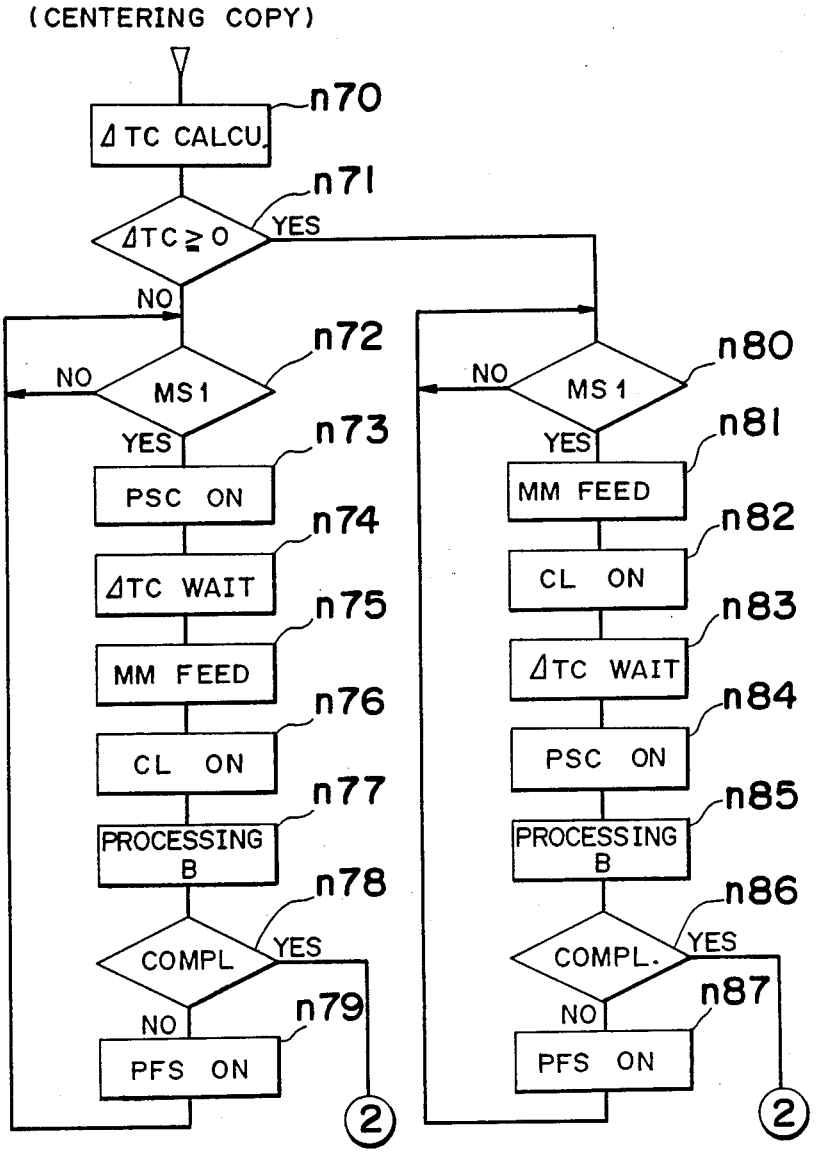
FIG. 11 is a flow-chart for explaining the processing procedure for a "centering" copying.

Referring further to FIG. 11, there is shown a flow-chart for explaining the processing procedures for the "centering" copying.

At first, calculation for ΔTC is effected at step n70 based on the equation (3) referred to earlier. If the value thus obtained is in the negative, the state of the paper detecting switch MS1 is first checked at step n72, and if the copy paper sheet is already held in contact with the paper starting clutch PSC, the clutch PSC is turned on at step n73 to start feeding of the copy paper sheet. At step n74, waiting for time ΔTC (absolute value) already obtained is effected, and after the lapse of the time period, the optical unit is started at step n75, with the copy lamp turned on at step n76. Step n77 relates to the processing from the transfer of the image onto the copy paper sheet thus fed, up to the discharge of the copy paper sheet onto the paper discharge tray at the final stage. Steps n78 and n79 relate to the judgement as to whether or not the copying for the number of sheets to be copied has been completed in the similar manner as in FIG. 10, and also, to the paper feeding for the subsequent copying.

As described above, in the case where ΔTC is negative, the image may be transferred at the central portion of a copy paper sheet by causing the optical unit to scan after the lapse of ΔTC in the absolute value subequent to feeding of the copy paper sheet.

In the case where ΔTC is above 0, it is first checked at step n80 whether or not the copy paper sheet is held in contact with the paper starting clutch PSC, and the scanning by the optical unit is started at step n81, while the copy lamp is turned on at step n82. Thereafter, at step n83, time waiting for ΔTC is effected and after the lapse of ΔTC, the paper starting clutch PSC is turned on at step n84 to feed the copy paper sheet. In the manner as described above, when ΔTC is of a positive value, by feeding the copy paper sheet after the lapse of time for ΔTC through scanning by the optical unit, image transfer may be effected, with the central portion of the copy paper sheet corresponding to the central portion of the original document.

Figure 12:
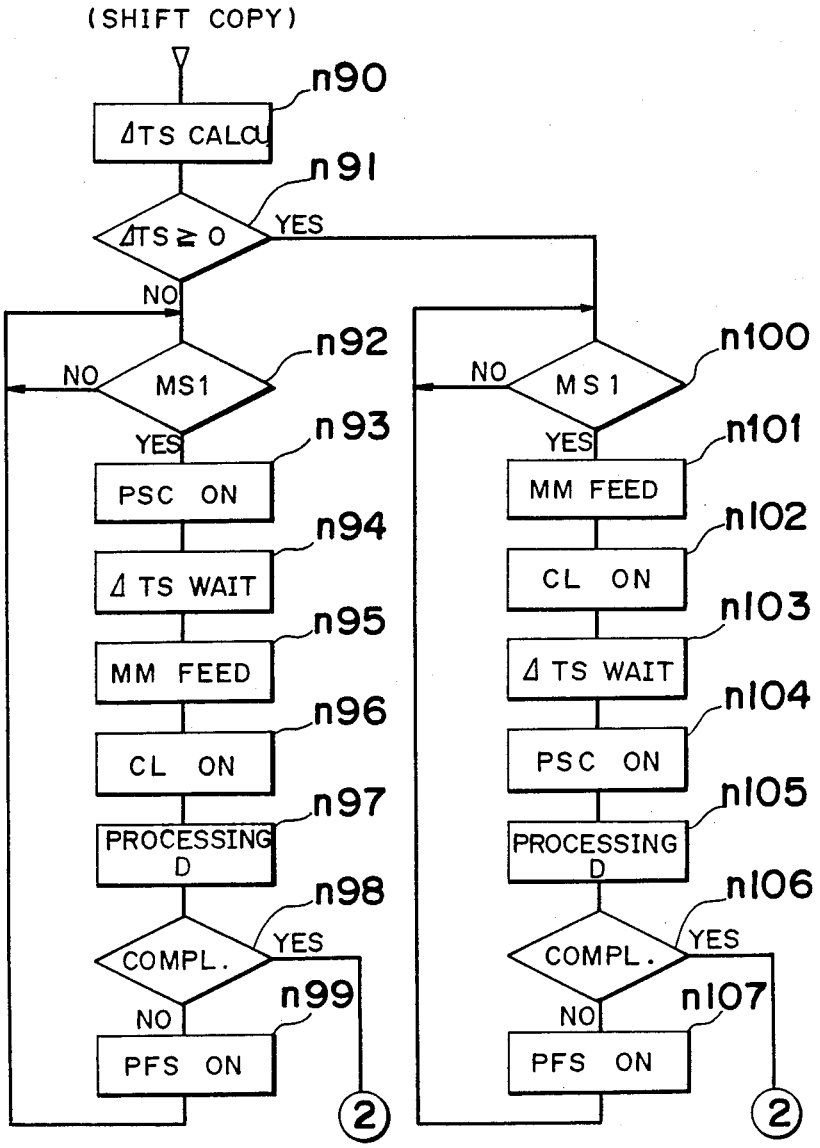
FIG. 12 is a flow-chart showing the processing procedure for a shift copying.

In FIG. 12, there is shown a flow-chart representing the processing procedure for effecting the shift copying.

In the first place, ΔTS is obtained at step n90. This ΔTS is obtained by calculating the time corresponding to the distance for the shift inputted by ten-keys at step n33 in FIG. 9(B), based on the equation (2) referred to earlier.

If the value for ΔTS is negative, the processings subsequent to step n92 are effected, while on the contrary, if the value is larger than 0 at step n91, the processings after step n100 are carried out. These processings are different only in the value for the time waiting in the case of the "centering" copying as shown in FIG. 1.

Figure 5:
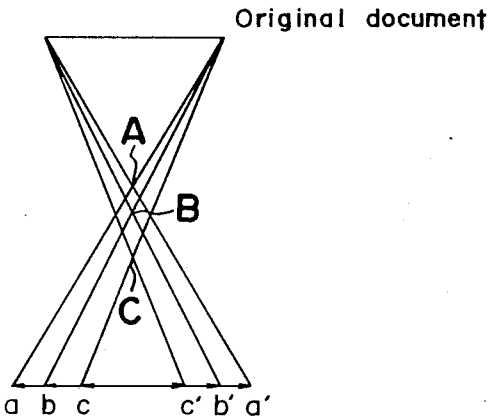
FIG. 5 is a diagram showing the relation between the original document and image with respect to each copying magnification.

FIG. 5 is a diagram showing the relation between the original documents and images on the photoreceptor drum in respective copying magnifications. As is seen from the above diagram, when the lens assembly is at A, the image on the photoreceptor drum has an image size of a to a', and when the lens assembly is at B, the image size is b to b', while when the lens assembly is at C, the image size is c to c'.

Figure 6:
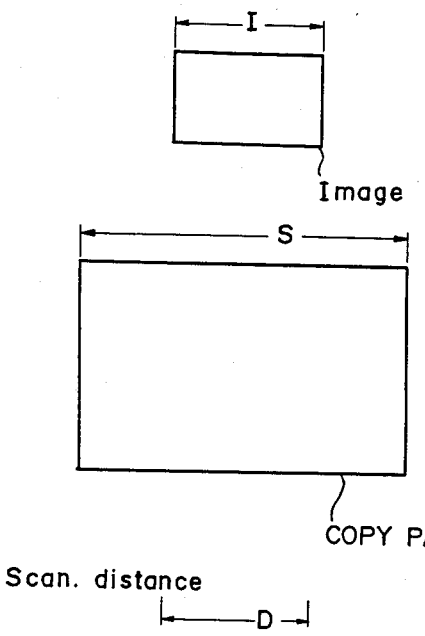
FIGS. 6 and 7 are diagrams respectively showing the relation among the image size, copy paper sheet size, and scanning distance of the original document scanning means.
Figure 7:
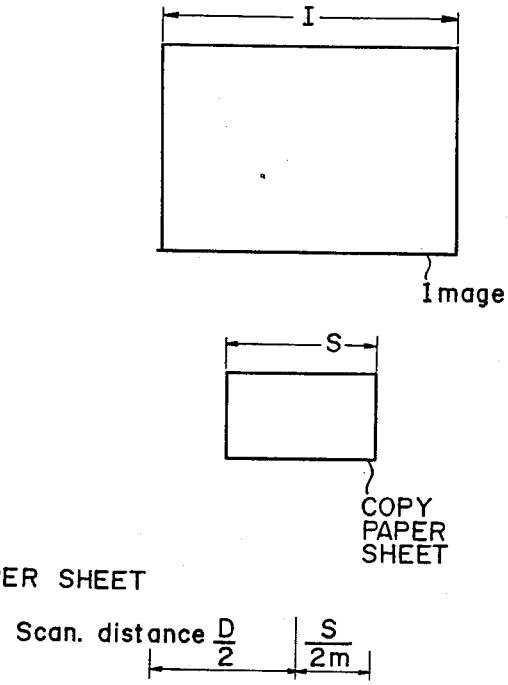

In FIGS. 6 and 7, there are shown such relations among the images, copy paper sheets, and scanning distances of the original document scanning means.

As shown in FIG. 6, in the case where the size I of the image is smaller than the size S of the copy paper sheet, the image may be transferred at the central portion of the copy sheet by causing the optical unit to scan by a distance equivalent to the image size, i.e. by a distance of the original document size D. Meanwhile, when the image on the photoreceptor drum is larger than the copy paper sheet as shown in FIG. 7, in order of project a front half (i.e. a left size half in the figure) of the image onto the photoreceptor drum, scanning by the optical unit over a distance equivalent to ½ i.e. over a distance D/2 is required. However, with respect to a latter half (i.e. a right side half in the figure) of the image, scanning distance by the optical unit becomes S/2m, since it is sufficient only to expose the image portion necessary for transfer onto the latter half (i.e. a right side half) of the copy paper sheet. Accordingly, the operating distance for the optical unit on the whole will be represented by (D+S/m)/2.

Figure 13:
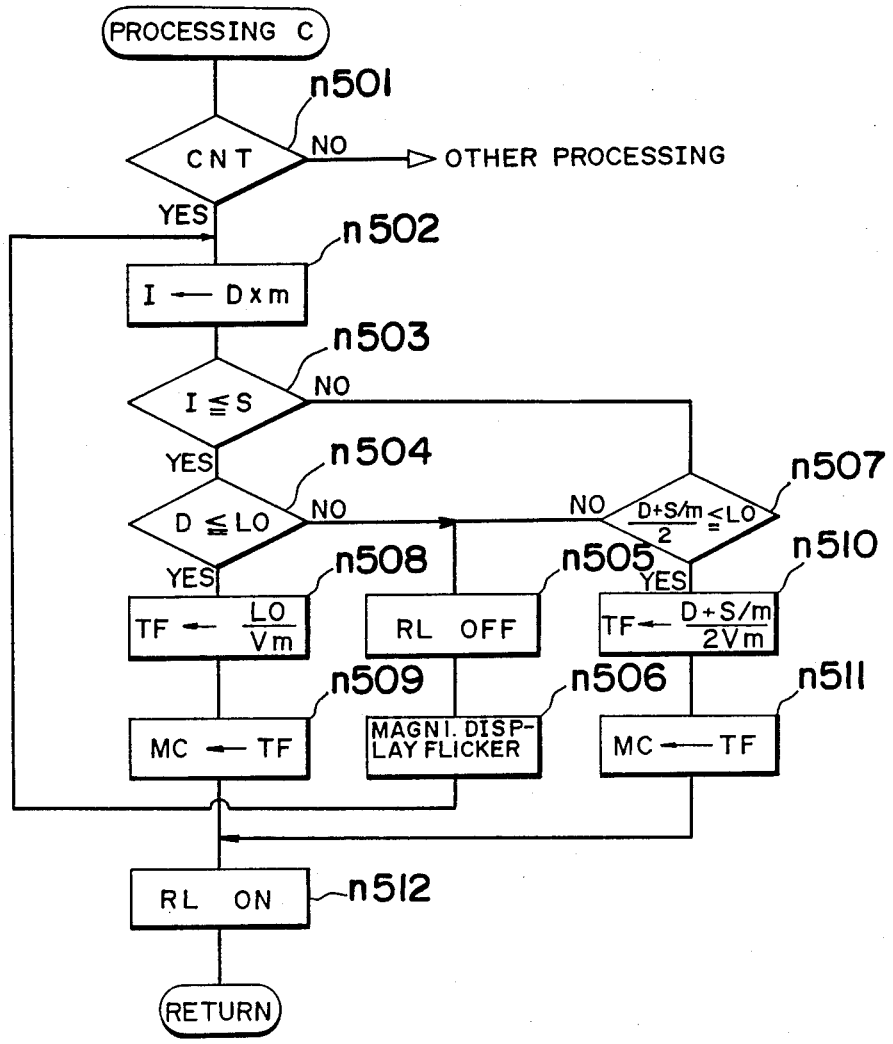
FIGS. 9(A), 9(B) and 13 are flow-charts showing the preliminary scanning, and processing procedures thereafter.

Reference is further made to the flow-chart of FIG. 13 showing step n50 in FIG. 9(B) described earlier.

First, at step n502, the size I of the image to be projected onto the photoreceptor drum is obtained by the product of the original document size D and the copying magnification m. At step n503, the value I is compared with the copy paper sheet size S to find which is larger or smaller, and if the value I is less than the copy paper sheet size S, comparison is effected at step n504 between the original document size D and an effective distance LO through which the original document platform may be scanned. This distance LO is to be determined by the interval between the third mirror and the lens assembly, and the copying magnification. If the original document size D is less than LO, it is possible to effect the intended copying. Meanwhile, if the original document size exceeds LO, copying is impossible, and the ready lamp is turned off at step n505, with the magnification display member being adapted to flicker at step n506. On the other hand, in the case where the size of the image on the photoreceptor drum is larger than the size of the copy paper sheet, the scanning distance of the original document scanning means is represented by (D+S/m)/2 as described earlier, and at step n507, it is judged whether or not this value is less than LO. Since the copying cannot be effected if the value exceeds LO, the ready lamp is turned off and the magnification display member is caused to flicker at steps n505 and n506 in a similar manner.

Step n508 is intended to find the time TF required for the scanning of the original document scanning means in the case where the size of the image on the photoreceptor drum is smaller than the copy paper sheet size, while step n510 is to find the similar time in the case where the size of the image on the photoreceptor drum exceeds the copy paper sheet size. The time thus obtained is inputted into the memory MC, and thereafter, at step n512, the ready lamp is turned on.

The time TF referred to above is used in the processings A, B and D as referred to earlier.

As is clear from the foregoing description, according to the present invention, it is possible to determine the transport timing of the copy paper sheet by preliminarily estimating the accelerating time required for the original document scanning means to scan from the home position to the reference position such as the original document leading edge position and thus, for example, the scanning of the original document scanning means may be started after the lapse of a predetermined time subsequent to feeding of the copy paper sheet, while the image to be transferred can be transferred at any desired position from the leading edge of the copy paper sheet. Accordingly, image editing, such as transfer of a contracted image onto the central portion of a copy paper sheet or transfer of an image onto a latter half of a copy paper sheet, may be effected over a wide range.

Moreover, since the preliminary scanning is effected only at the timepoint such as the time for power source turning on, there is no particular inconvenience in the ordinary copying operation. Furthermore, by effecting the preliminary scanning a plurality of times for different copying magnifications so as to obtain the average value of the accelerating time for the original document scanning means such as the optical unit, the accelerating time at any desired magnification may be obtained more accurately.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A copying apparatus comprising:

original document scanning means for scanning an original document to be copied, said original document scanning means including a reciprocating optical unit and an original document platform or the like, to scan at a constant speed, with the scanning speed thereof being controlled according to copying magnifications;

means for preliminarily scanning by said original document scanning means before a copying exposure scanning at speeds corresponding to at least two different copying magnifications;

means for measuring an acceleration time of said original document scanning means from a home position to a reference position in a constant speed moving section corresponding to said at least two different copying magnifications by said preliminary scanning;

means for calculating an acceleration time corresponding to any required copying magnification based on information of the acceleration time corresponding to said at least two different copying magnifications; and means for setting timing for feeding a leading edge of a copy paper sheet to a transfer position, based on a reference time obtained by adding time required for an exposure position on a photoreceptor drum to reach the transfer position, to said calculated acceleration time.

2. A copying apparatus as claimed in claim 1, further comprising a copying factor setting means for setting copying factors including copy paper sizes, original document sizes and copying magnifications through input or automatic detection, and a copy paper sheet feeding time calculating means for calculating the copy paper sheet feeding time between a copy paper sheet leading edge position and an image leading edge position in the case of copying at a central portion on the copy paper sheet based on the copying factors thus set, said copy paper sheet leading edge feeding timing setting means being adapted to set the timing based on a reference time obtained by adding time required for the exposure position on the photoreceptor drum to reach the transfer position and also, time calculated by said copy paper sheet feeding time calculating means, to said calculated acceleration time.

3. A copying apparatus comprising:

original document scanning means for scanning an original document to be copied, said original document scanning means including a reciprocating optical unit and an original document platform or the like, to scan at a constant speed, with the scanning speed thereof being controlled according to copying magnifications;

copying factor setting means for setting copying factors including copy paper sizes, original document size and copying magnifications through input or automatic detection;

copy paper sheet feeding time calculating means for calculating the copy paper sheet feeding time between a copy paper sheet leading edge position and an image leading edge position in the case of copying at a central portion on the copy paper sheet based on the copying factors set;

means for preliminarily scanning by said original document scanning means before a copying exposure scanning at speeds corresponding to at least two different copying magnifications;

means for measuring acceleration time of said original document scanning means from a home position to a reference position in a constant speed moving section corresponding to said at least two different copying magnifications by said preliminary scanning;

means for calculating acceleration time corresponding to any required copying magnification based on information of the acceleration time corresponding to said at least two different copying magnifications; and means for setting timing for feeding a leading edge of a copy paper sheet to a transfer position, based on a reference time obtained by adding time required for an exposure position on a photoreceptor drum to reach the transfer position and a time calculated by said copy paper sheet feeding time calculating means, to said calculated acceleration time.

* * * * *